United States Patent [19]

Garcia, Jr.

[11] Patent Number: 4,816,970

[45] Date of Patent: Mar. 28, 1989

[54] SOLAR POWERED LIGHT

[76] Inventor: Manuel Garcia, Jr., Route 2, Box 138, Moses Lake, Wash. 98837

[21] Appl. No.: 918,276

[22] Filed: Oct. 14, 1986

[51] Int. Cl.[4] ..... F21L 7/00

[52] U.S. Cl. ..... 362/183; 362/157; 362/186

[58] Field of Search ..... 362/186, 183, 356, 190, 362/191, 157

[56] References Cited

U.S. PATENT DOCUMENTS

| | | | |
|---|---|---|---|
| 2,894,173 | 7/1959 | Paradise | 362/183 |
| 3,027,450 | 3/1962 | Everest | 362/311 |
| 3,317,809 | 5/1967 | Bower et al. | 362/183 |
| 4,319,310 | 3/1982 | Kingsby | 362/183 |
| 4,486,820 | 12/1984 | Baba et al. | 362/190 |
| 4,502,102 | 2/1985 | Phipps | 362/186 |
| 4,663,697 | 5/1987 | Stearn et al. | 362/186 |

*Primary Examiner*—Samuel Scott
*Assistant Examiner*—Noah Kamen
*Attorney, Agent, or Firm*—Leon Gilden

[57] ABSTRACT

A self-charging light utilizes a rechargeable nickel-cadmium battery pack and a plurality of solar electric panels. The battery powers a lamp attached to a top portion of the assembly. The lamp is covered with a shade that includes an interior mirrored surface so as to reflect emitted light downwardly upon the solar panel. As such, when the lamp is illuminated, it serves to partially recharge itself while also illuminating the surrounding area.

9 Claims, 3 Drawing Sheets

SOLAR POWERED LIGHT

BACKGROUND OF THE INVENTION

1. Field of the Invention

The present invention relates to solar powered lights, and more particularly pertains to a self-charging solar powered lamp which includes the use of a reflective shade for directing illumination directly onto the associated solar panel.

2. Description of the Prior Art

The use of lighting equipment which is adapted to be powered by solar energy is well known in the prior art. For example, U.S. Pat. No. 4,319,310, which issued to V. Kingsley on Mar. 9, 1982, discloses a solar sign which is of a self-contained construction. The sign utilizes incident solar energy through the use of solar cells to generate electricity which is stored and later used for illuminating the sign lamps. The lamps are directed downwardly to reflect upon the sign surface, while the associated solar cells are positioned above the lamps and out of the illumination pattern.

Similarly, U.S. Pat. No. 4,441,143, which issued to C. Richardson, Jr., on Apr. 3, 1984, discloses a photovoltaic lightning system for an outdoor telephone booth. Rechargeable storage batteries and an electrical control circuit are utilized to provide illumination within the booth during those periods of time when natural illumination is not available, while a solar cell assembly is positioned on a top surface of the booth to charge the storage cells during the daylight hours. When the lamps in the phone booth are illuminated, no light reflects on the surface of the storage cells.

The above-discussed patents are representative of a far larger number of patents which could have been provided regarding the construction of solar powered assemblies. All of these prior art assemblies utilize lamp systems which are illuminated at night, with solar panels being positioned above the lamp illumination patterns so that no further electricity is generated by the solar panels during non-daylight hours. As such, it can be appreciated that there is a continuing need for new and improved solar powered lamps wherein the solar panel assemblies could effectively continue to generate some electricity for recharging associated storage cells during non-daylight hours and in this respect, the present invention substantially fulfills this need.

SUMMARY OF THE INVENTION

In view of the foregoing disadvantages inherent in the known types of solar powered lamps now present in the prior art, the present invention provides an improved solar powered lamp wherein its illumination pattern is directed over a solar panel so as to recapture some of the battery power expended during an illumination of the lamp. As such, the general purpose of the present invention, which will be described subsequently in greater detail, is to provide a new and improved solar powered lamp which has all the advantages of the prior art solar powered lamps and none of the disadvantages.

To attain this, the present invention comprises a battery-powered lamp mounted on a housing which contains rechargeable nickel-cadmium batteries. Inasmuch as solar energy can be utilized to charge rechargeable batteries as discussed in U.S. Pat. No. 4,463,727, which issued to R. Curiel on Jan. 7, 1986 and the disclosure of which is incorporated herein by reference, a plurality of solar panels are attached around the lamp base to effect a recharging of the battery pack during daylight hours. To improve the efficiency of the invention, the lamp is positioned directly over the solar panels so that the panels are activated during an illumination of the lamp. As such, a discharge of electrical energy through the lamp is partially recovered by the activation of the solar panels during the evening hours while the lamp is illuminated. To further enhance the recharging function of the solar panels during non-daylight hours, the inner surface of the lampshade associated with the lamp may be coated with a reflective or mirrored surface so as to direct maximum illumination onto the solar panels. By the same token, the lampshade can be constructed of a one-way mirror material with the mirror surface being on the interior portion of the lampshade, thereby to facilitate the passage of light through the shade onto the solar panels during the daylight hours.

There has thus been outlined, rather broadly, the more important features of the invention in order that the detailed description thereof that follows may be better understood, and in order that the present contribution to the art may be better appreciated. There are, of course, additional features of the inventin that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved solar powered lamp which has all the advantages of the prior art solar powered lamps and none of the disadvantages.

It is another object of the present invention to provide a new and improved solar powered lamp which may be easily and efficiently manufactured and marketed.

It is a further object of the present invention to provide a new and improved solar powered lamp which is of a durable and reliable construction.

An even further object of the present invention is to provide an new and improved solar powered lamp which is susceptible of a low cost of manufacture with regard to both materials and labor, and which accordingly is then susceptible of low prices of sale to the consuming public, thereby making such solar powered lamps economically available to the buying public.

Still yet another object of the present invention is to provide a new and improved solar powered lamp which provides in the apparatuses and methods of the prior art some of the advantages thereof, while simultaneously overcoming some of the disadvantages normally associated therewith.

Still another object of the present invention is to provide a new and improved solar powered lamp which is operable to partially recharge itself during non-daylight hours.

Yet another object of the present invention is to provide a new and improved solar powered lamp which makes a more efficient use of its illumination energy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
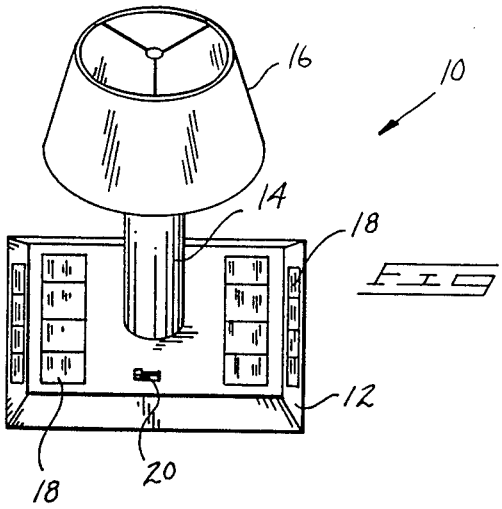
FIG. 1 is a front perspective view of the solar powered lamp comprising the present invention.
Figure 4:
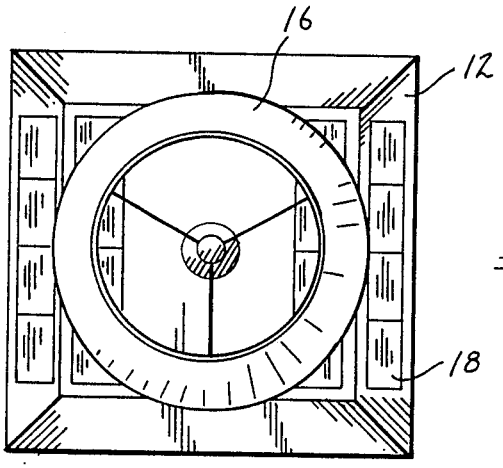
FIG. 4 is a top plan view of the lamp.
Figure 2:
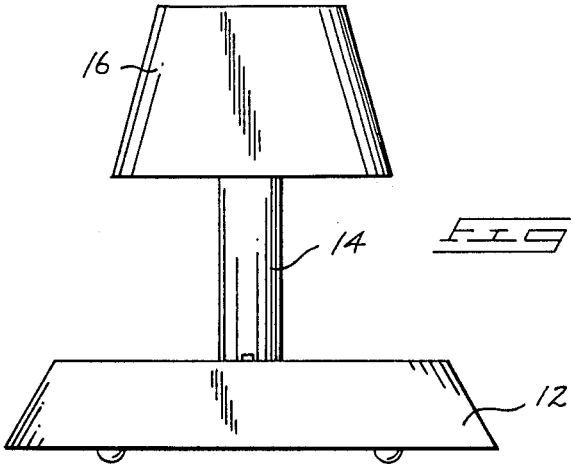
FIG. 2 is a front elevation view of the lamp.
Figure 3:
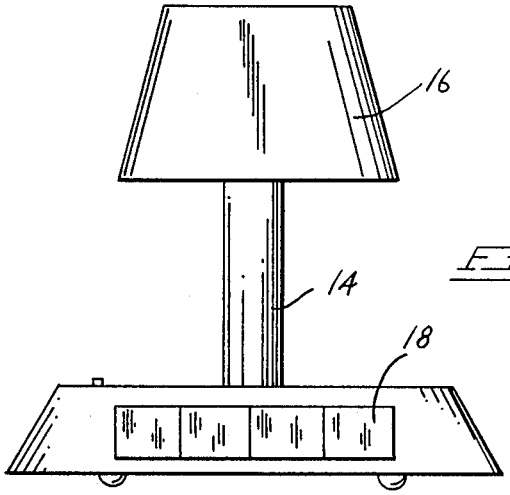
FIG. 3 is a right side elevation view of the lamp.
Figure 5:
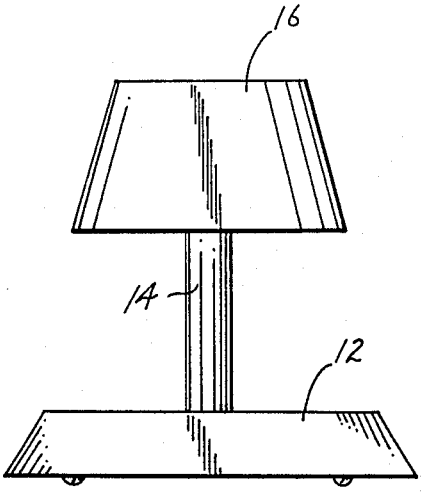
FIG. 5 is a rear elevation view of the invention.
Figure 6:
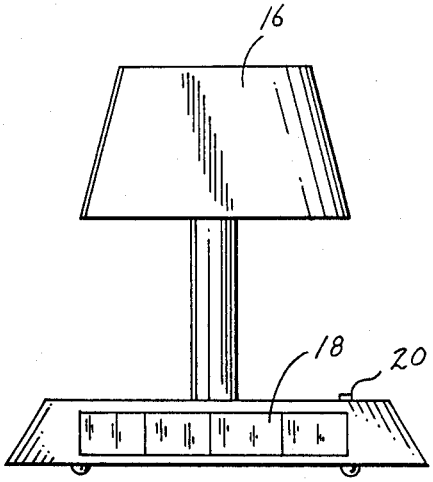
FIG. 6 is a left side elevation view of the invention.
Figure 7:
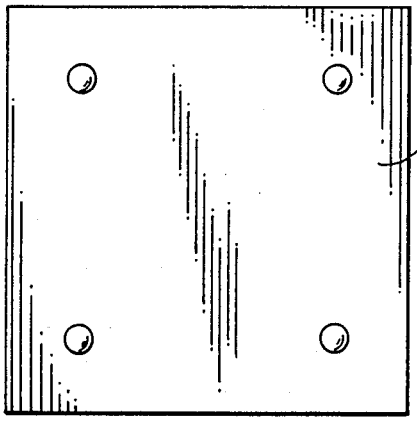
FIG. 7 is a bottom plan view thereof.

With reference now to the drawings, and in particular to FIGS. 1–7 thereof, a new and improved solar powered lamp embodying the principles and concepts of the present invention and generally designated by the reference numeral 10 will be described.

More specifically, it will be noted that the lamp 10 essentially comprises a rectangularly shaped base 12 having an upstanding support 14 attached to a topmost surface thereof. The support 14 serves to hold an unillustrated light bulb beneath a lampshade 16 with the shade being positioned to reflect light downwardly over the lamp base 12.

Further illustrated in FIGS. 1–7 are a plurality of solar panels 18 positioned along sides and top surfaces of the lamp base 12 while an electric power on-and-off switch 20 is also illustrated. The solar panels 18 serve to provide electrical chargin power to an unillustrated nickel-cadmium rechargeable battery pack in a manner similar to that illustrated in U.S. Pat. No. 4,563,727 as above-mentioned with the disclosure thereof being incorporated herein by reference.

Inasmuch as the lampshade 16 with its associated light bulb is positioned above the solar panels 18, it can be appreciated that the illumination pattern provided by the light bulb will be directed downwardly over the solar panels. As such, the solar panels 18 will be activated by the light bulb to thereby continually supply electric power to the rechargeable battery pack which in turn powers the light bulb. Of course, the recharging current will be substantially less than the current being utilized to power the light bulb; however, the period of operation of the light bulb from the battery pack will be extended by this construction.

During daylight hours when the light bulb is not activated, the lampshade 16 would normally prevent some of the solar energy from reaching the solar panels 18. This is precisely the reason why most solar panels are positioned above an illumination source. To overcome the disadvantages of having the lampshade 16 positioned over the solar panels 18, the lampsahde may be constructed of a substantially transparent material to thereby the facilitate the passage of light rays therethrough. Inasmuch as the construction of a transparent lampshade 16 would be self defeating during an illumination of the light bulb, the interior surface of the lampshade may be provided with a mirrored or otherwise reflective surface for directing the light rays from the light bulb downwardly over the solar panels 18. This objective can be obtained through the use of a one-way mirror material in the construction of the lampshade 16 whereby a majority of the light rays are prevented from passing through the interior surface of the lampshade 16 during an illumination of the light bulb, while substantially all of the light rays are permitted to pass through the exterior surface of the lampshade so as to come into contact with the solar panels 18.

With respect to the manner of usage and operation of the present invention, the same should be apparent from the above description. Accordingly, no further discussion regarding the manner of usage and operation of the invention will be provided.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved solar powered lamp comprising: base means;

light bulb support means attached to said base means;

at least one light bulb mounted on said light bulb support means;

lampshade means attached to said light bulb support means and covering said light bulb;

power supply means comprising a rechargeable battery for providing illuminating power to said light bulb; and, solar panel means for supplying electric charging energy to said rechargeable battery, said solar panel means being positioned within an illumination pattern of said light bulb, thereby to generate charging energy to said rechargeable battery during periods of illumination of said light bulb, said solar panel means being mounted upon said base means beneath said lampshade means.

2. The solar powered lamp of claim 1, and further including switch means for operably controlling said illumination of said light bulb.

3. The solar powered lamp of claim 2, wherein said lampshade means is shaped to direct light rays directly onto said solar panel means.

4. The solar powered lamp of claim 3, wherein said lampshade means includes an inner reflective surface for directing said light rays upon said solar panel means.

5. The solar powered lamp of claim 4, wherein said inner surface of said lampshade means is mirrored.

6. The solar powered lamp of claim 5, wherein said lampshade means is constructed of a one-way mirrored material, thereby to facilitate a passage of light rays though an exterior surface of said lampshade means.

7. The solar powered lamp of claim 6, wherein said lampshade means is constructed from a semi-transparent material.

8. The solar powered lamp of claim 7, wherein said lampshade means includes an inner reflective surface.

9. The solar powered lamp of claim 8, wherein said inner reflective surface is mirrored.

* * * * *